United States Patent [19]

Ouellette

[11] 4,164,887

[45] Aug. 21, 1979

[54] MULTIPLE BUOY LAUNCHER

[75] Inventor: Charles W. Ouellette, Portsmouth, R.I.

[73] Assignee: Raytheon Company, Lexington, Mass.

[21] Appl. No.: 866,209

[22] Filed: Jan. 3, 1978

[51] Int. Cl.[2] ..... F41F 5/02

[52] U.S. Cl. ..... 89/1.5 R; 102/37.6

[58] Field of Search ..... 89/1.5 R, 1.5 E; 102/37.6, 37.7, 34.5

[56] References Cited

U.S. PATENT DOCUMENTS

| | | | |
|---|---|---|---|
| 2,381,332 | 8/1945 | Boldt | 89/1.5 R |
| 3,451,306 | 6/1969 | Lagerstrom et al. | 102/37.6 X |
| 4,019,421 | 4/1977 | Ström | 89/1.5 R |
| 4,026,188 | 5/1977 | Woodruff et al. | 89/1.5 R |

*Primary Examiner*—David H. Brown

*Attorney, Agent, or Firm*—David M. Warren; Joseph D. Pannone; Milton D. Bartlett

[57] ABSTRACT

A launching tube accommodates sonobuoys of differing lengths for individually launching the sonobuoys. Compressed gas modules located between the sonobuoys are individually activated by electrical signals to expel respective sonobuoys from the launching tube. Electrical contacts on the modules engage electrically conducting guides on the inner surface of the launching tube whereby the electrical signals are communicated individually to respective ones of the modules.

3 Claims, 3 Drawing Figures

MULTIPLE BUOY LAUNCHER

BACKGROUND OF THE INVENTION

The dropping of sonobuoys from aircraft as a means of positioning sonobuoys in remote parts of the ocean for oceanographic survey is being utilized with increasing frequency. The numerous launching from the aircraft of sonobuoys of differing sizes has created a need for a launching device capable of stowing and launching a plurality of sonobuoys of differing sizes.

SUMMARY OF THE INVENTION

The aforementioned need is met and other advantages are provided by a buoy launcher which, in accordance with the invention, comprises a cylindrical launching tube with electrically conducting guides located longitudinally along the inner surface of the tube. A set of compressed gas modules, referred to as firing modules, is employed for expelling buoys such as sonobuoys, from the launching tube. The firing modules are arranged alternately with the buoys of a set of buoys along the axis of the launching tube so that the first firing module expels the first buoy and the second firing module expels both the second buoy and the spent first firing module from the launching tube. Each firing module has an electrical contact which is oriented for fitting into a specific one of the aforementioned guides to permit individual electrical activation of each firing module so that each buoy can be launched at a predetermined instant of time. Mechanical stops inserted through the wall of the launching tube at the locations of the firing modules maintain the firing modules at their respective positions until a stop is fractured by the propulsive force of a firing module.

BRIEF DESCRIPTION OF THE DRAWINGS

The aforementioned aspects and other features of the invention are explained in the following description taken in connection with the accompanying drawings wherein.

DESCRIPTION OF THE PREFERRED EMBODIMENT

Figure 1:
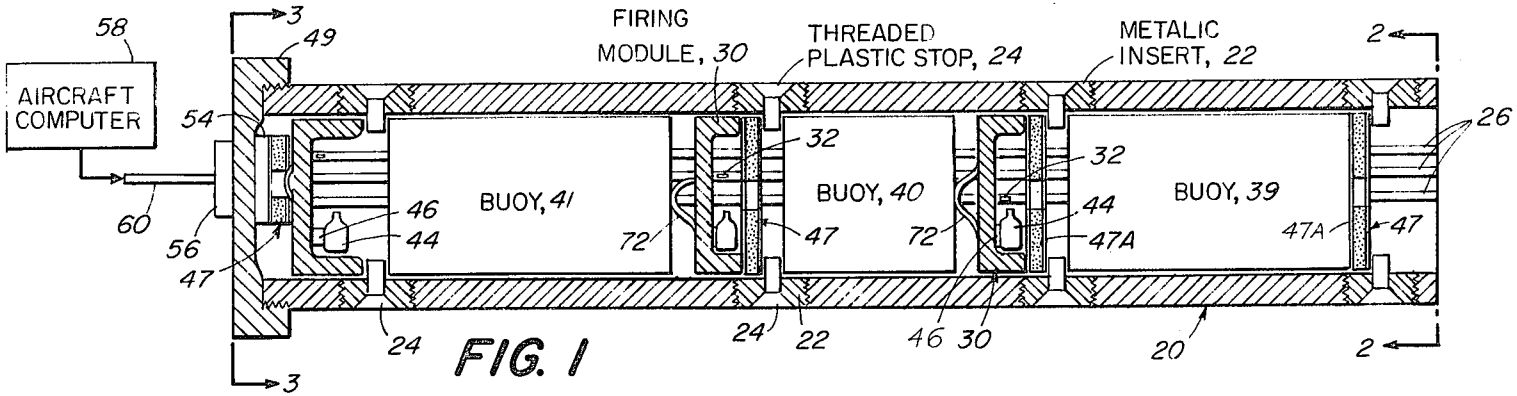
FIG. 1 is a sectional view of a launching tube, in accordance with the invention, showing a set of buoys and a set of firing modules contained in the tube, the firing modules also being shown in section.
Figure 3:
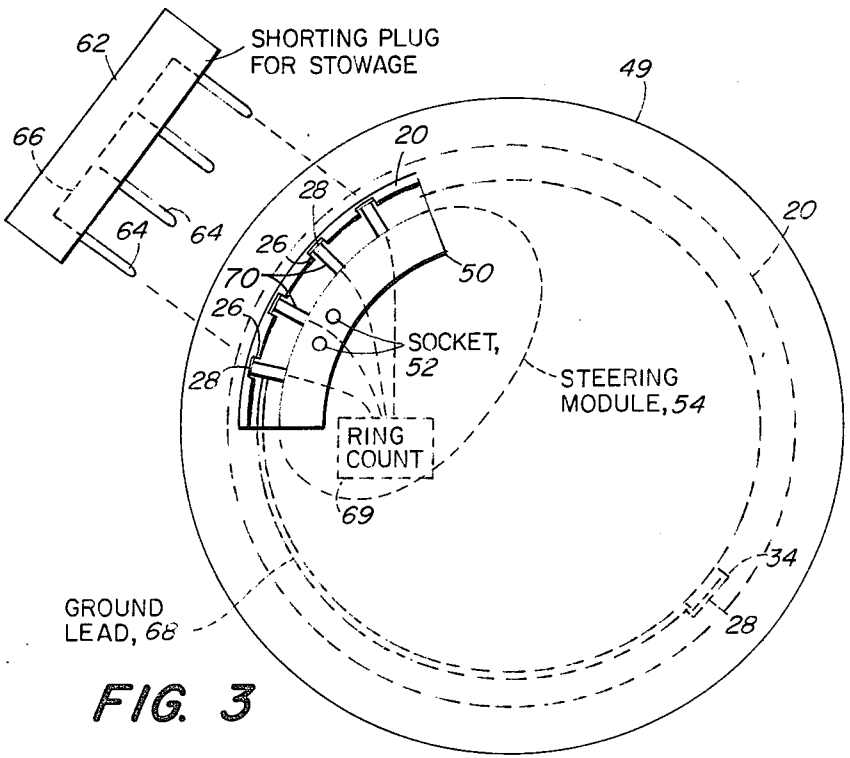
FIG. 3 is a view of the back end of the launching tube of FIG. 1 in which a steering module is partially seen through an aperture in a cover of the tube, the view being taken along the lines 3—3 of FIG. 1.
Figure 2:
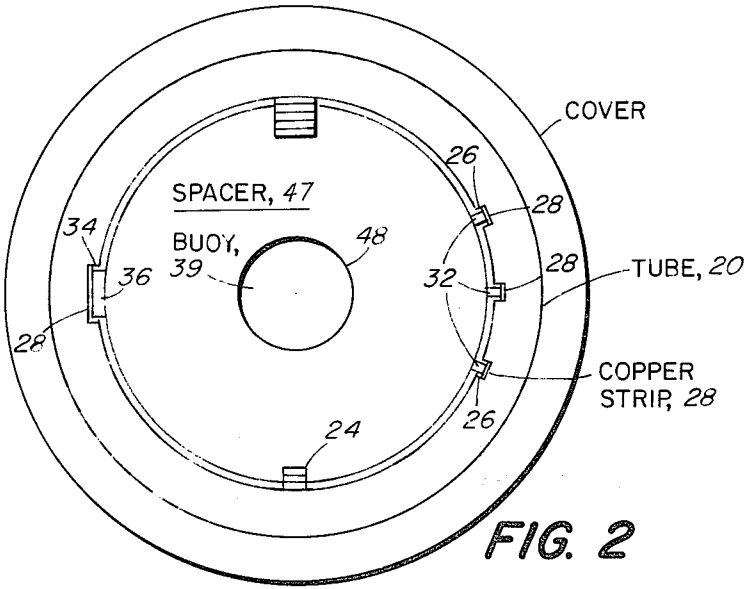
FIG. 2 shows a view of the front end of the launching tube from which a buoy is expelled, the view being taken along the lines 2—2 of FIG. 1.

Referring now to the FIGS. 1-3, there is seen a launching tube 20 which, in accordance with the invention, comprises a set of metallic inserts 22 which are threadedly secured to the wall of the tube 20, and a set of stops 24 which are fabricated of an easily fractured plastic material and are configured in the form of screws for being threadedly secured in the inserts 22. The launching tube 20 itself may be fabricated of a plastic or fiberglass material and has a set of guides 26 in the form of channels cut into the inner surface of the tube 20, there being a copper strip 28 adhesively secured along the floor of each guide 26 for conducting electrical signals to respective ones of firing modules 30.

Each firing module 30 is provided with a contact 32 which mates with one of the guides 26, the module 30 being oriented relative to the axis of the tube 20 prior to insertion of the module 30 into the tube 20 so that a contact 32 of the module 30 engages a desired one of the guides 26. A larger guide 34 having a copper strip 28 mates with a larger contact 36 on each of the modules 30 to facilitate positioning the modules 30 along the axis of the tube 20 and to serve as a ground for the electrical signals of the guides 26.

In accordance with the invention, different sized buoys 39, 40 and 41 of differing lengths, but having equal diameters, are inserted in the tube 20 in alternating positions with the modules 30. Typically, the buoys 39–41 are sonobuoys of the type utilized in making oceanographic surveys. The stops 24 secure the buoys 39–41 in their respective positions and are sequentially fractured during sequential expulsions of the buoys 39–41 from the tube 20. Each module 30 is seen to comprise a compressed gas cartridge 44, such as a carbon dioxide cartridge, and includes an electrically triggered squib 46 which, in response to an electrical signal communicated via a guide 26, activates the cartridge 44 to release the compressed gas which serves a propellant for expelling the buoy, such as the buoy 39, immediately in front of the module 30.

Spacers 47 of a foamed material such as foamed polyurethane serve as cushions for securing the buoys 39–41 between the stops 24, and are positioned in front of the buoy 39, the first module 30, and the second module 30, and also behind the third module 30. Rigid disks 47A, such as a disk of solid polyurethane at the front side and back side of the spacers 47 provide contacting surfaces for butting against the stops 24 and the modules 30. An aperture 48 within a spacer 47 permits gas from a cartridge 44 to completely fill the region between a module 30 and a buoy such as the buoy 39. The foamed material retains its resilience during storage so that upon the firing of a module 30, such as the module 30 behind the buoy 39, compressive forces of the expanding gases are resisted by the masses of the buoys 40 and 41 as well as a cover 49 which preclude premature fracturing of stops 24 behind the buoy 39.

A cover 49 is threadedly secured to the back end of the tube 20 by rotating the cover 49 one-quarter turn. The rotation of one-quarter turn positions an aperture 50 therein above the termini of the guides 26 and also above a socket 52 of a steering module 54 secured to the interior side of the cover 49. The socket 52 mates with a plug 56 whereby signals are coupled from a computer 58 and cable 60 aboard an aircraft to signal the steering module 54 to fire one of the buoys 39–41. A shorting plug 62 has pins 64 electrically coupled together by a conductor 66, the pins 64 being in registration with the guides 26 and an additional guide 67 which is of sufficient length to reach the module 54 and is connected via a ground lead 68 to the guide 34. Thereby the pins 64 can be inserted into the guides 26 for shorting together the copper strips 28 and thereby preventing an accidental discharge of a buoy 39–41 during stowage of the launching tube 20 in the aircraft. The plug 62 is removed when it is desired to deploy the buoys 39–41, and the plug 56 is then inserted into the socket 52.

The module 54 may comprise a ring counter 69 which is coupled by a set of contacts 70 of the module 54 to individual ones of the guides 26. Upon activation of the counter 69 by clock pulses from the computer 58, the counter 69 successively energizes the strips 28 in respective ones of the guides to trigger the squibs 46, one squib 46 being triggered upon the occurrence of each clock pulse from the computer 58.

With the application of the first clock pulse by the computer 58 to the steering module 54, the firing module 30 located behind the first buoy 39 is activated by the steering module 54 to expel the buoy 39 from the launching tube 20. The propulsive force of the expanding gas from the cartridge 44 results in a fracturing of the first pair of stops 24 upon the expulsion of the buoy 39 from the launching tube. The first module 30 is retained within the launching tube 20 by the second pair of stops. Upon activation of the second firing module 30, the second buoy 40 and the first firing module 30 are expelled by the propulsive force of the expanding gas. The propulsive force results in a fracturing of the second pair of stops so that the firing module 30 and the buoy 40 can exit from the tube 20. It is noted that, until the activation of the second firing module 30, the second pair of stops 24 remains intact to hold the spent first module 30 within the tube 20 so that it does not accidentally fall out and strike a portion of the aircraft carrying the launching tube 20. Upon the expulsion of the first firing module 30 by the expanding gases of the second module 30, the first module 30 as well as the buoy 40 exit rapidly from the tube 20 so as to clear all parts of the aircraft. The firing modules 30 are fabricated of a light weight metal such as aluminum and have a retracting tab 72 on the back side thereof to facilitate the positioning of the buoys 40 and 41 while inserting the stops 24.

It is understood that the above-described embodiment of the invention is illustrative only and that modifications thereof may occur to those skilled in the art. Accordingly, it is desired that this invention is not to be limited to the embodiments disclosed herein but is to be limited only as defined by the appended claims.

What is claimed is:

1. A launcher comprising:

a launching tube having longitudinal electrical conductors therein, said launching tube having longitudinal guides therein;

means positioned along a wall of said tube for locating buoys therein, each of said buoys having means for slidably contacting said guides for orienting said buoys about an axis of said tube, said contact making slidable electrical contact with one of said conductors; and a set of firing modules positionable within said tube in alternating locations with said buoys, each of said firing modules being coupled to one of said contacts for contacting a specific one of said longitudinal conductors to permit individual activation of said firing modules in response to electrical signals coupled via said electrical conductors.

2. A launcher according to claim 1 further comprising means coupled to said longitudinal conductors and responsive to a series of electrical signals for sequentially triggering individual ones of said firing modules in response to successive ones of said electrical signals, and wherein said longitudinal electrical conductors are located within said longitudinal guides to permit said contacts to be guided by said guides as said contacts make electrical contact with said conductors.

3. A launcher comprising:

a launching tube having longitudinal electrical conductors therein;

a set of stops positioned in a wall of said tube for locating buoys therein;

a set of firing modules positionable within said tube in alternating locations with said buoys, each of said firing modules having an electrical contact for contacting a specific one of said longitudinal conductors to permit individual activation of said firing modules in response to electrical signals coupled via said electrical conductors;

means coupled to said longitudinal conductors and responsive to a series of electrical signals for sequentially triggering individual ones of said firing modules in response to successive ones of said electrical signals; and a cover at and end of said tube, said cover providing access to said longitudinal conductors and plug means for contacting said longitudinal conductors via said cover for shorting said conductors together to insure deactivation of said firing modules.

* * * * *